US011536419B1

(12) United States Patent
Lu et al.

(10) Patent No.: US 11,536,419 B1
(45) Date of Patent: Dec. 27, 2022

(54) LIGHTING DEVICE WITH IMPROVED LUMINOUS PERFORMANCE

(71) Applicant: Xiamen PVTECH Co., Ltd., Fujian (CN)

(72) Inventors: Fuxing Lu, Fujian (CN); Zhirong Lin, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 17/668,337

(22) Filed: Feb. 9, 2022

(30) Foreign Application Priority Data

Dec. 8, 2021 (CN) ..... 202111492684.8

(51) Int. Cl.
*F21K 9/60* (2016.01)
*F21Y 115/10* (2016.01)
*F21K 9/90* (2016.01)

(52) U.S. Cl.
CPC ..... *F21K 9/60* (2016.08); *F21K 9/90* (2013.01); *F21Y 2115/10* (2016.08)

(58) Field of Classification Search
CPC ..... F21K 9/60; F21K 9/90
See application file for complete search history.

(56) References Cited

U.S. PATENT DOCUMENTS 9,644,828 B1 * 5/2017 May ..... F21S 9/022
2015/0285474 A1 * 10/2015 Martin ..... H05K 1/0295 362/249.02
2016/0040838 A1 * 2/2016 Zaderej ..... F21V 23/06 362/249.02
2016/0186940 A1 * 6/2016 Del Castillo ..... F21K 9/278 362/249.06

* cited by examiner

*Primary Examiner* — Eric T Eide
(74) *Attorney, Agent, or Firm* — Winston Hsu

(57) ABSTRACT

A lighting device with improved luminous performance is provided, which includes a first light path, a second light path and a plurality of first light sources and second light sources. The first light path includes a plurality of first bending portions and second bending portions arranged in staggered arrangement. Each first bending portion and each second ending portion protrude from one side and the other side of a first reference line respectively. The first light sources are distributed over the second bending portions. The second light path is connected to the first light path in parallel, and includes a plurality of third bending portions and fourth bending portions arranged in the staggered arrangement. Each third bending portion and each fourth bending portion protrude from one side and the other side of a second reference line respectively. The second light sources are distributed over the third bending portions.

8 Claims, 4 Drawing Sheets

LIGHTING DEVICE WITH IMPROVED LUMINOUS PERFORMANCE

BACKGROUND OF THE INVENTION

1. Field of the Invention

The present invention relates to a lighting device, in particular to a lighting device with improved luminous performance.

2. Description of the Prior Art

Due to rapid advance of technology, the performances of various lighting devices are also significantly improved. In order to improve the luminous performance of a lighting device, it is necessary to make the light emitted by the lighting device more uniform. Light-emitting diodes (LEDs) of the same production batch are usually packaged in the same bag, and the qualities and characteristics of these LEDs are usually similar to each other. Thus, if a lighting device is installed with the LEDs of different production batches, the brightness of the lighting device may be not uniform, which significantly influences the luminous performance of the lighting device. Accordingly, the LEDs packaged in one bag should be used in only one lighting device and the residual LEDs need to be discarded, which dramatically increases the manufacturing cost of lighting devices.

Besides, a currently available lighting device may have two or more light paths and each of the light paths is provided with a plurality of LEDs. However, different light paths may have different impedances because of the circuit design of the lighting device. Accordingly, the currents pass through the light paths may be also different from each other, so the brightness of the lighting device may be non-uniform, which deteriorates the luminous performance of the lighting device.

SUMMARY OF THE INVENTION

The present invention is related to a lighting device with improved luminous performance. In one embodiment of the present invention, the lighting device includes a first light path, a plurality of first light sources, a second light path and a plurality of second light sources. The first light path includes a plurality of first bending portions and a plurality of second bending portions. The first bending portions and the second bending portions are arranged in staggered arrangement. Each of the first bending portions protrudes from one side of a first reference line and each of the second bending portions protrudes from the other side of the first reference line. The first light sources are distributed over the second bending portions. The second light path is connected to the first light path in parallel and includes a plurality of third bending portions and a plurality of fourth bending portions. The third bending portions and the fourth bending portions are arranged in the staggered arrangement. Each of the third bending portions protrudes from one side of a second reference line and each of the fourth bending portions protrudes from the other side of the second reference line. The second light sources are distributed over the third bending portions.

In one embodiment of the present invention, the first light sources are connected to each other in series and the second light sources are connected to each other in series.

In one embodiment of the present invention, the first bending portions are corresponding to the third bending portions respectively and the second bending portions are corresponding to the fourth bending portions respectively.

In one embodiment of the present invention, one end of the first light path and one end of the second light path are connected to a positive power source input terminal via a positive common node. The other end of the first light path and the other end of the second light path are connected to a negative power source input terminal via a negative common node.

In one embodiment of the present invention, the sum of the quantity of the first light sources and the quantity of the second light sources disposed at one side of a central reference line is equal to the sum of the quantity of the first light sources and the quantity of the second light sources disposed at the other side of the central reference line.

In one embodiment of the present invention, the central reference line passes through the central point of the first light path and the central point of the second light path.

In one embodiment of the present invention, the total impedance of the first light path is substantially equal to the total impedance of the second light path.

In one embodiment of the present invention, the first light sources and the second light sources are light-emitting diodes.

In one embodiment of the present invention, the shape of the first light path is a square wave, a sine wave or an irregular wave.

In one embodiment of the present invention, the shape of the second light path is a square wave, a sine wave or an irregular wave.

The lighting device with improved luminous performance in accordance with the embodiments of the present invention may have the following advantages:

(1) In one embodiment of the present invention, the lighting device with improved luminous performance has several serpentine light paths and the light paths are arranged in staggered arrangement. This special circuit design makes the impedances of these light paths are substantially equal to or close to each other. Thus, the light emitted by the lighting device can be more uniform, so the luminous performance of the lighting device can be significantly optimized.

(2) In one embodiment of the present invention, the lighting device with improved luminous performance can make the impedances of the light paths are substantially equal to or close to each other via the special circuit design. Accordingly, the influence due to the quality consistency of the LEDs installed on the light paths can be reduced, which can decrease the waste of natural resources. Therefore, the manufacturing cost of the lighting device can be greatly reduced.

(3) In one embodiment of the present invention, the lighting device with improved luminous performance can make the impedances of the light paths are substantially equal to or close to each other via the special circuit design. Therefore, the light emitted by the lighting device can be more uniform, which can really correspond with the actual needs.

(4) In one embodiment of the present invention, the lighting device with improved luminous performance can be applied to various types of lighting devices and can achieve great technical effects. Thus, the lighting device can be more flexible in use and more comprehensive in application.

(5) In one embodiment of the present invention, the design of the lighting device with improved luminous performance can achieve the desired technical effects without significantly increasing the cost. Hence, the lighting device can have great commercial value.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will become more fully understood from the detailed description given herein below and the accompanying drawings which are given by way of illustration only, and thus are not limitative of the present invention and wherein.

DETAILED DESCRIPTION

Figure 1:
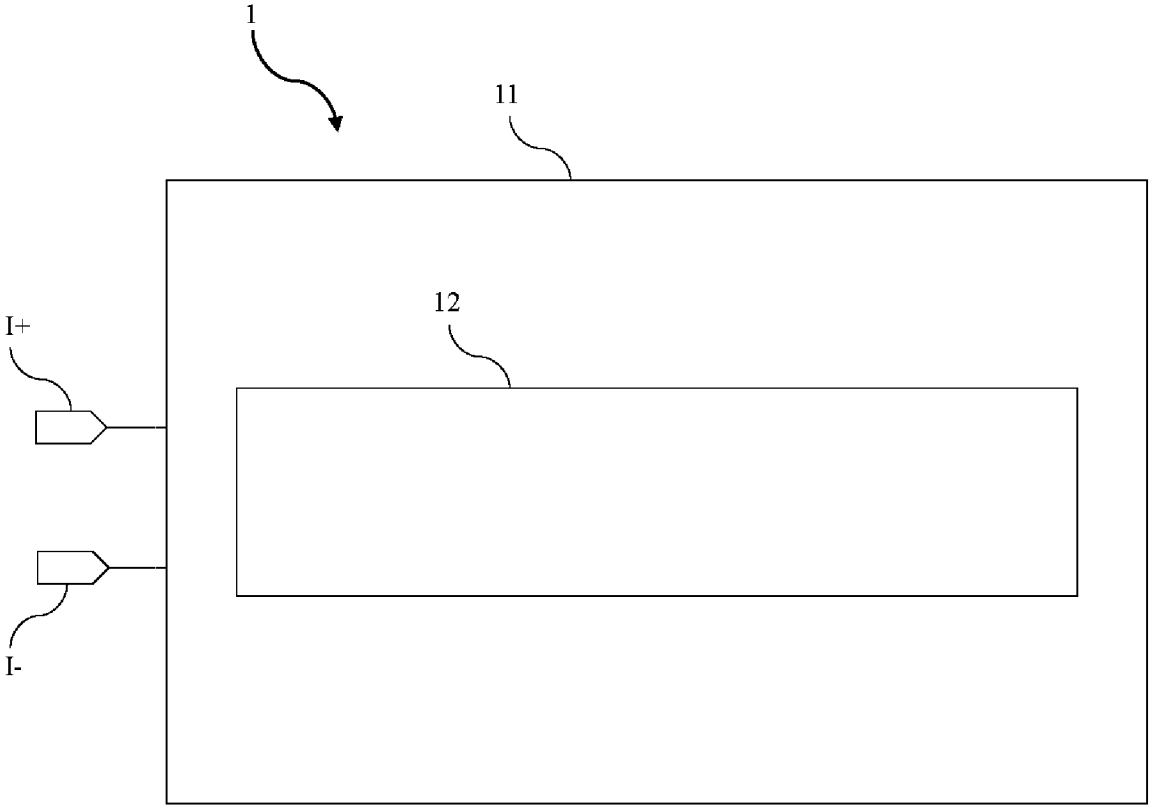
FIG. 1 is a schematic view of a lighting device with improved luminous performance in accordance with a first embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing. It should be understood that, when it is described that an element is "coupled" or "connected" to another element, the element may be "directly coupled" or "directly connected" to the other element or "coupled" or "connected" to the other element through a third element. In contrast, it should be understood that, when it is described that an element is "directly coupled" or "directly connected" to another element, there are no intervening elements.

Please refer to FIG. 1, which is a schematic view of a lighting device with improved luminous performance in accordance with a first embodiment of the present invention. As shown in FIG. 1, the lighting device 1 with improved luminous performance includes a housing 11 and a light source board 12. The light source board is disposed in the housing 11. The light source board 12 is connected to a positive power source input terminal I+ and a negative power source input terminal I−.

Figure 2:
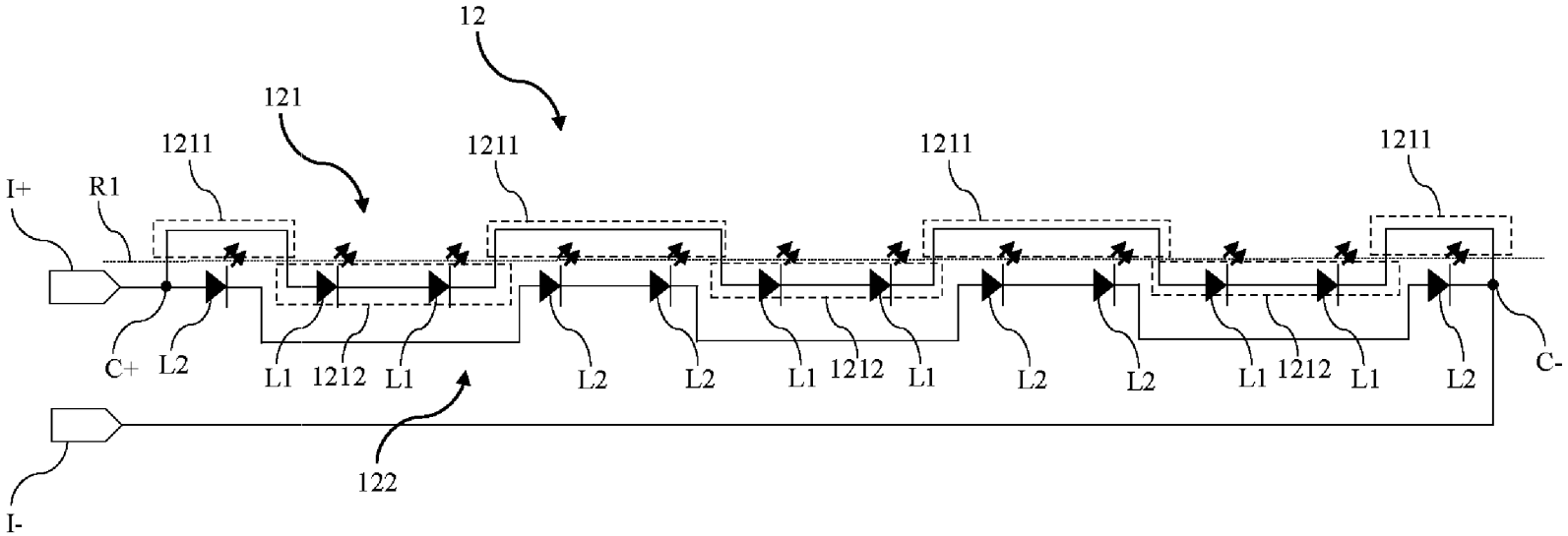
FIG. 2 is a first schematic view of a circuit structure of the lighting device with improved luminous performance in accordance with the first embodiment of the present invention.
Figure 3:
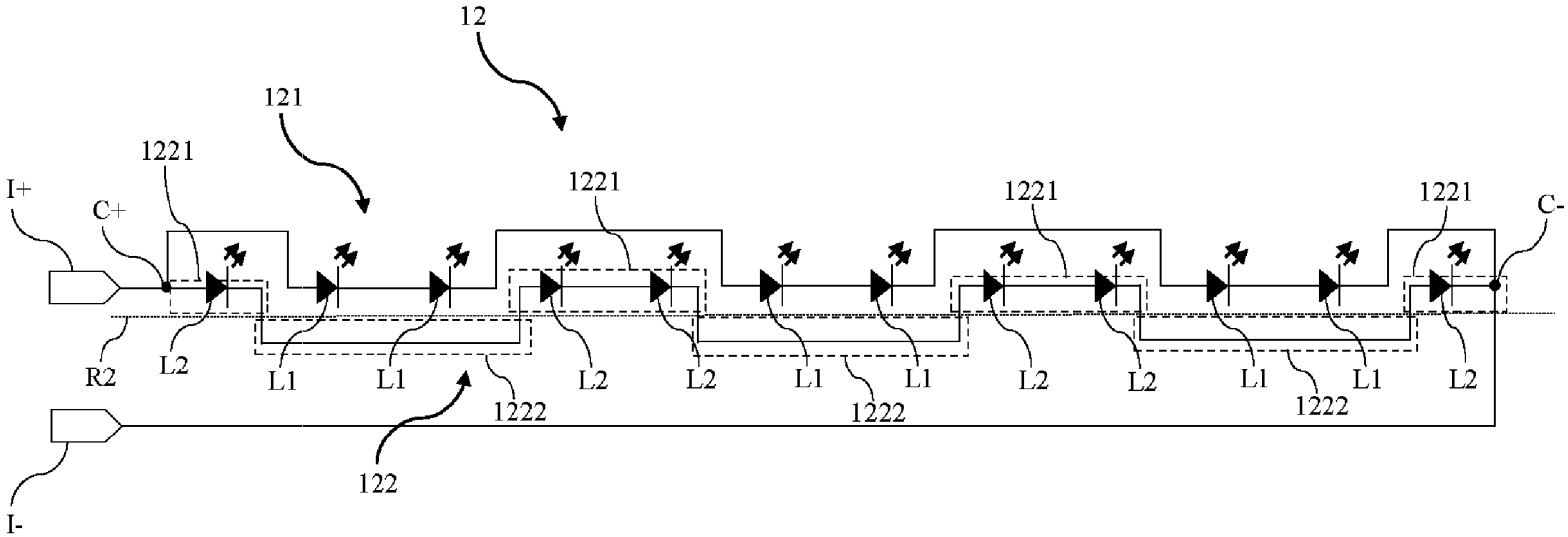
FIG. 3 is a second schematic view of the circuit structure of the lighting device with improved luminous performance in accordance with the first embodiment of the present invention.

Please refer to FIG. 2 and FIG. 3, which are a first schematic view and a second schematic view of a circuit structure of the lighting device with improved luminous performance in accordance with the first embodiment of the present invention. As shown in FIG. 2, the light source board 12 of the lighting device 1 includes a first light path 121, a plurality of first light sources L1, a second light path 122 and a plurality of second light sources L2.

The first light path 121 includes a plurality of first bending portions 1211 and a plurality of second bending portions 1212. The first bending portions 1211 and the second bending portions 1212 are arranged in staggered arrangement. Each of the first bending portions 1211 protrudes from one side of a first reference line R1 and each of the second bending portions 1212 protrudes from the other side of the first reference line R1. Thus, in this embodiment, the first light path 121 is serpentine and the shape thereof is similar to a square wave. In another embodiment, the shape of the first light path 121 may be a sine wave or an irregular wave.

The first light sources L1 are distributed over the second bending portions 1212, such that the first light sources L1 are connected to each other in series. The first bending portions 1211 are not provided with any light source. In one embodiment, the first light sources L1 may be light-emitting diodes (LEDs).

As shown in FIG. 3, the second light path 122 includes a plurality of third bending portions 1221 and a plurality of fourth bending portions 1222. The third bending portions 1221 and the fourth bending portions 1222 are arranged in staggered arrangement. Each of the third bending portions 1221 protrudes from one side of a second reference line R2 and each of the fourth bending portions 1222 protrudes from the other side of the second reference line R2. Thus, in this embodiment, the second light path 122 is also serpentine and the shape thereof is similar to a square wave. In another embodiment, the shape of the second light path 122 may be a sine wave or an irregular wave.

The second light sources L2 are distributed over the third bending portions 1221, such that the second light sources L2 are connected to each other in series. The fourth bending portions 1222 are not provided with any light source. In one embodiment, the second light sources L2 may be LEDs.

As shown in FIG. 2 and FIG. 3, one end of the first light path 121 and one end of the second light path 122 are connected to the positive power source input terminal I+ via a positive common node C+. The other end of the first light path 121 and the other end of the second light path 122 are connected to the negative power source input terminal I− via a negative common node C—.

Moreover, the first bending portions 1211 are corresponding to the third bending portions 1221 respectively and the second bending portions 1212 are corresponding to the fourth bending portions 1222 respectively. Accordingly, the first light path 121 and the second light path 122 are arranged in staggered arrangement.

As set forth above, the lighting device 1 has at least two serpentine light paths, the first light path 121 and the second light path 122, and the first light path 121 and the second light path 122 are arranged in staggered arrangement. In addition, the layout of the first light sources L1 and the second light sources L2 are also specially designed. This special circuit design makes the total impedance of the first light path 121 is substantially equal to or close to the total impedance of the second light path 122. Thus, the light emitted by the lighting device 1 can be more uniform, so the luminous performance of the lighting device 1 can be significantly optimized.

Further, the lighting device 1 can make the impedances of the light paths are substantially equal to or close to each other via the special circuit design. Accordingly, the influence due to the quality consistency of the LEDs installed on the light paths can be reduced, which can decrease the waste of natural resources. Therefore, the manufacturing cost of the lighting device 1 can be greatly reduced.

The embodiment just exemplifies the present invention and is not intended to limit the scope of the present invention; any equivalent modification and variation according to the spirit of the present invention is to be also included within the scope of the following claims and their equivalents.

It is worthy to point out that a currently available lighting device may have two or more light paths, but different light paths may have different impedances because of the limits caused by the circuit design of the lighting device. Accordingly, the currents pass through the light paths may be also different from each other, so the brightness of the lighting device may be non-uniform, which deteriorates the luminous performance of the lighting device. On the contrary, according to one embodiment of the present invention, the lighting device with improved luminous performance has several serpentine light paths and the light paths are arranged in staggered arrangement. This special circuit design makes the impedances of these light paths are substantially equal to or close to each other. Thus, the light emitted by the lighting device can be more uniform, so the luminous performance of the lighting device can be significantly optimized.

Also, the currently available lighting device has a high requirement in the quality consistency of the LEDs on the light paths thereof. Accordingly, the LEDs packaged in one bag should be used in only one lighting device and the residual LEDs need to be discarded, which dramatically increases the manufacturing cost of the lighting device. On the contrary, according to one embodiment of the present invention, the lighting device with improved luminous performance can make the impedances of the light paths are substantially equal to or close to each other via the special circuit design. Accordingly, the influence due to the quality consistency of the LEDs installed on the light paths can be reduced, which can decrease the waste of natural resources. Therefore, the manufacturing cost of the lighting device can be greatly reduced.

Further, according to one embodiment of the present invention, the lighting device with improved luminous performance can make the impedances of the light paths are substantially equal to or close to each other via the special circuit design. Therefore, the light emitted by the lighting device can be more uniform, which can really correspond with the actual needs.

Moreover, according to one embodiment of the present invention, the lighting device with improved luminous performance can be applied to various types of lighting devices and can achieve great technical effects. Thus, the lighting device can be more flexible in use and more comprehensive in application.

Furthermore, according to one embodiment of the present invention, the design of the lighting device with improved luminous performance can achieve the desired technical effects without significantly increasing the cost. Hence, the lighting device can have great commercial value. As described above, the lighting device according to the embodiments of the present invention can actually achieve great technical effects.

Figure 4:
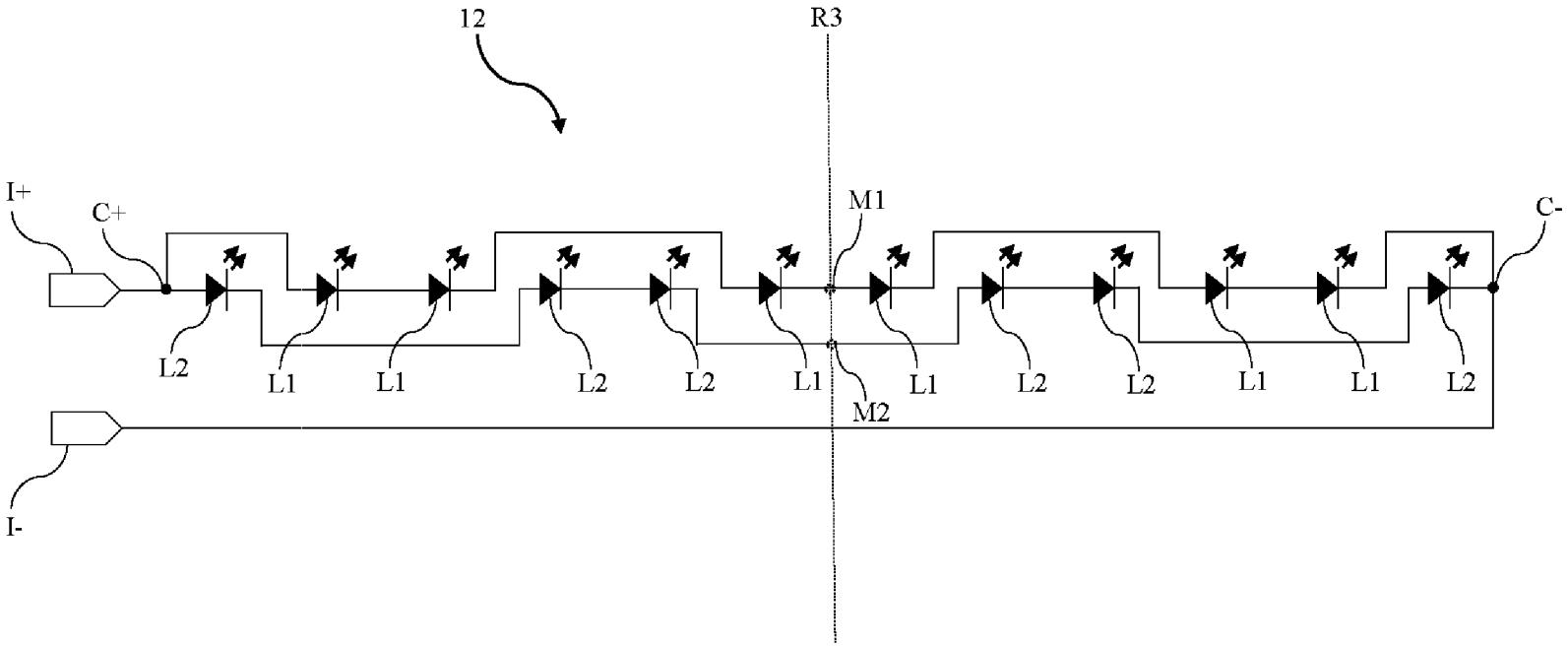
FIG. 4 is a schematic view of a circuit structure of a lighting device with improved luminous performance in accordance with a second embodiment of the present invention.

Please refer to FIG. 4, which are a schematic view of a circuit structure of a lighting device with improved luminous performance in accordance with a second embodiment of the present invention. As shown in FIG. 4, the light source board 12 of the lighting device 1 includes a first light path 121, a plurality of first light sources L1, a second light path 122 and a plurality of second light sources L2. A central reference line R3 passes through the central point M1 of the first light path 121 and the central point M2 of the second light path 122.

The above elements are similar to those of the first embodiment, so will not be described therein again. The difference between this embodiment and the first embodiment is that the sum of the quantity of the first light sources L1 and the quantity of the second light sources L2 disposed at one side of the central reference line R3 is equal to the sum of the quantity of the first light sources L1 and the quantity of the second light sources L2 disposed at the other side of the central reference line R3. The above design can make the total impedance of the first light path 121 is closer to the total impedance of the second light path 122. In this way, the light emitted by the light device 1 can be more uniform, which can further improve the luminous performance of the light device 1.

The embodiment just exemplifies the present invention and is not intended to limit the scope of the present invention; any equivalent modification and variation according to the spirit of the present invention is to be also included within the scope of the following claims and their equivalents.

To sum up, according to one embodiment of the present invention, the lighting device with improved luminous performance has several serpentine light paths and the light paths are arranged in staggered arrangement. This special circuit design makes the impedances of these light paths are substantially equal to or close to each other. Thus, the light emitted by the lighting device can be more uniform, so the luminous performance of the lighting device can be significantly optimized.

Also, according to one embodiment of the present invention, the lighting device with improved luminous performance can make the impedances of the light paths are substantially equal to or close to each other via the special circuit design. Accordingly, the influence due to the quality consistency of the LEDs installed on the light paths can be reduced, which can decrease the waste of natural resources. Therefore, the manufacturing cost of the lighting device can be greatly reduced.

Further, according to one embodiment of the present invention, the lighting device with improved luminous performance can make the impedances of the light paths are substantially equal to or close to each other via the special circuit design. Therefore, the light emitted by the lighting device can be more uniform, which can really correspond with the actual needs.

Moreover, according to one embodiment of the present invention, the lighting device with improved luminous performance can be applied to various types of lighting devices and can achieve great technical effects. Thus, the lighting device can be more flexible in use and more comprehensive in application.

Furthermore, according to one embodiment of the present invention, the design of the lighting device with improved luminous performance can achieve the desired technical effects without significantly increasing the cost. Hence, the lighting device can have great commercial value.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A lighting device with improved luminous performance, comprising:

a first light path, comprising a plurality of first bending portions and a plurality of second bending portions, wherein the first bending portions and the second bending portions are arranged in staggered arrangement, and each of the first bending portions protrudes from one side of a first reference line and each of the second bending portions protrudes from the other side of the first reference line;

a plurality of first light sources, distributed over the second bending portions;

a second light path, connected to the first light path in parallel, and comprising a plurality of third bending portions and a plurality of fourth bending portions, wherein the third bending portions and the fourth bending portions are arranged in the staggered arrangement, and each of the third bending portions protrudes from one side of a second reference line and each of the fourth bending portions protrudes from the other side of the second reference line; and a plurality of second light sources, distributed over the third bending portions;

wherein the first bending portions are corresponding to the third bending portions respectively, and a length difference between any one of the first bending portion and the third bending portion corresponding thereto is less than a length of the third bending portion, wherein the second bending portions are corresponding to the fourth bending portions respectively, and a length difference between any one of the fourth bending portion and the second bending portion corresponding thereto is less than a length of the second bending portion, whereby a total impedance of the first light path is substantially equal to a total impedance of the second light path.

2. The lighting device with improved luminous performance as claimed in claim 1, wherein the first light sources are connected to each other in series and the second light sources are connected to each other in series.

3. The lighting device with improved luminous performance as claimed in claim 1, wherein one end of the first light path and one end of the second light path are connected to a positive power source input terminal via a positive common node, and the other end of the first light path and the other end of the second light path are connected to a negative power source input terminal via a negative common node.

4. The lighting device with improved luminous performance as claimed in claim 1, wherein a sum of a quantity of the first light sources and a quantity of the second light sources disposed at one side of a central reference line is equal to a sum of a quantity of the first light sources and a quantity of the second light sources disposed at the other side of the central reference line.

5. The lighting device with improved luminous performance as claimed in claim 4, wherein the central reference line passes through a central point of the first light path and a central point of the second light path.

6. The lighting device with improved luminous performance as claimed in claim 1, wherein the first light sources and the second light sources are light-emitting diodes.

7. The lighting device with improved luminous performance as claimed in claim 1, wherein a shape of the first light path is a square wave, a sine wave or an irregular wave.

8. The lighting device with improved luminous performance as claimed in claim 1, wherein a shape of the second light path is a square wave, a sine wave or an irregular wave.

* * * * *